US007775329B2

(12) United States Patent
Eckenstein et al.

(10) Patent No.: US 7,775,329 B2
(45) Date of Patent: Aug. 17, 2010

(54) METHOD AND DETECTION SYSTEM FOR MONITORING THE SPEED OF AN ELEVATOR CAR

(75) Inventors: Rudolf Eckenstein, Baar (CH); Carlos Latorre Marcuz, Shanghai (CN); Eric Birrer, Luzern (CH); Karsten Gensicke, Buchrain (CH)

(73) Assignee: Inventio AG, Hergiswil NW (CH)

( * ) Notice: Subject to any disclaimer, the term of this patent is extended or adjusted under 35 U.S.C. 154(b) by 668 days.

(21) Appl. No.: 11/404,649

(22) Filed: Apr. 14, 2006

(65) Prior Publication Data

US 2006/0237265 A1 Oct. 26, 2006

(30) Foreign Application Priority Data

Apr. 21, 2005 (EP) ..... 05103256

(51) Int. Cl.
*B66B 1/34* (2006.01)

(52) U.S. Cl. ..... 187/391; 187/277; 187/286; 187/287; 187/393

(58) Field of Classification Search ..... 187/277, 187/286, 287, 391, 393
See application file for complete search history.

(56) References Cited

U.S. PATENT DOCUMENTS 4,124,101 A 11/1978 Satoh
4,128,142 A 12/1978 Satoh et al.
4,130,184 A 12/1978 Satoh et al.
4,177,973 A 12/1979 Miller et al.
4,263,988 A 4/1981 Inaba et al.
4,345,670 A * 8/1982 Kaneko et al. ..... 187/248
4,367,810 A * 1/1983 Doane et al. ..... 187/280
4,844,205 A * 7/1989 Klingbeil ..... 187/293
4,928,796 A * 5/1990 Poon ..... 187/288
5,323,878 A * 6/1994 Nakamura et al. ..... 187/264
5,612,517 A 3/1997 Johansson
5,648,644 A * 7/1997 Nagel ..... 187/288
6,173,814 B1 * 1/2001 Herkel et al. ..... 187/288
6,394,231 B1 * 5/2002 Schuster et al. ..... 187/382
2003/0159890 A1 * 8/2003 Schuster et al. ..... 187/247

(Continued)

FOREIGN PATENT DOCUMENTS

AR 254540 9/2000

(Continued)

*Primary Examiner*—Walter Benson
*Assistant Examiner*—Kawing Chan
(74) *Attorney, Agent, or Firm*—Fraser Clemens; Martin & Miller LLC; William J. Clemens

(57) ABSTRACT

A method and detection system monitors the speed of an elevator car and, in case of excess speed caused by brake failure of a motor brake or shaft fracture of a drive pulley shaft, a safety circuit is opened and the detection system is transferred from a normal operational state (State 1) to a retardation state (State 2) in which it is monitored whether the elevator car is retarded after defined speed presets. After a successful retardation, the detection system is transferred to a state of standstill monitoring (State 3) in which it is monitored whether the elevator car leaves its standstill position. If the presets of State 2 or State 3 are not fulfilled, the detection system is transferred to a braking state of the brake (State 4) in which a brake which fixes the elevator car is activated.

11 Claims, 3 Drawing Sheets

U.S. PATENT DOCUMENTS

| | | | | |
|---|---|---|---|---|
| 2004/0079590 | A1 | 4/2004 | Sweet | |
| 2004/0079591 | A1* | 4/2004 | Mueller | 187/287 |
| 2004/0173413 | A1* | 9/2004 | Angst et al. | 187/287 |
| 2004/0178024 | A1* | 9/2004 | Deplazes et al. | 187/394 |

FOREIGN PATENT DOCUMENTS

| | | | |
|---|---|---|---|
| EP | 0 643 006 | A1 | 3/1995 |

* cited by examiner

METHOD AND DETECTION SYSTEM FOR MONITORING THE SPEED OF AN ELEVATOR CAR

BACKGROUND OF THE INVENTION

The present invention relates to a method and a detection system for monitoring the speed of an elevator car, wherein the movement of a drive pulley driving the elevator car and a counterweight is detected and evaluated and in the case of impermissible deviation of the speed of the elevator car from a speed preset a retardation is initiated.

A motorized cable drum is shown in U.S. Pat. No. 4,177,973, in which the motor shaft and the drum shaft are electrically monitored. A respective sensor for detection of shaft revolutions is provided for each shaft. The signals of the sensors are compared, wherein the ratio of the revolutions of the motor shaft to the revolutions of the drum shaft corresponds in the course of normal operation with the transmission ratio of the transmission. If a result departing from the transmission ratio is produced by the signal evaluation, a braking device acting on the cable drum is activated.

A disadvantage of this known equipment is that complicated hardware is necessary for monitoring the cable drum, which is costly in provision and maintenance.

SUMMARY OF THE INVENTION

Here the present invention creates a remedy. The present invention fulfils the object of avoiding the disadvantages of the known equipment and of providing a method by means of which the speed of an elevator car can be monitored by simple means.

In the case of the method according to the present invention for monitoring the speed of an elevator car, the movement of a drive pulley driving the elevator car and a counterweight is detected and evaluated and, in the case of excess speed of the elevator car or in the case of an impermissible deviation of the speed of the elevator car from a speed preset, a retardation of the elevator car is initiated. It is monitored whether the elevator car after predetermined presets is retarded and if the retardation runs after the predetermined presets, it is further monitored whether the elevator car leaves its standstill position and/or if the retardation of the elevator car does not run after the predetermined presets or if the elevator car has left a standstill position, a brake fixing the elevator car is activated.

In the case of the detection system according to the present invention for monitoring the speed of an elevator car, a measuring system detects the movement of the drive pulley driving the elevator car and a counterweight and a computer evaluates signals of the measuring system, which computer in the case of excess speed of the elevator car initiates a retardation process. If a speed limit is exceeded, the detection system opens a safety circuit and stores the excess speed of the elevator car from the zero instant of detection of the safety circuit as open, and wherein the detection system after a defined time from the instant zero monitors whether the speed of the elevator car is less than the excess speed and wherein the detection system after a defined time from the instant zero monitors whether the speed of the elevator car is less than half the excess speed and wherein the detection system after a defined time from the instant zero monitors whether the speed of the elevator car is less than a standstill speed.

The advantages achieved by the present invention are that the speed or the speed change in the case of retardation of the elevator car can be monitored by the method according to the present invention and the equipment according to the present invention.

Advantageously, a brake is activated if the monitored speed does not fall below predetermined values or if the elevator car has left the standstill position. Safety risks arising from risky states such as excess speed of the elevator car, failure of the motor brake during travel on movement to a floor, failure of the motor brake at a floor stop or shaft fracture of the drive pulley shaft can be avoided by the method according to the present invention or the equipment according to the present invention.

A cable brake, a car brake or a safety brake device, for example, can be provided as a brake.

The cable brake is arranged to be fixed to the body of the building or to the support structure of the elevator and acts on the support cable functioning as support means. In the case of braking, the support cables are fixed. The car brake or the safety brake device is arranged at the elevator car and acts on stationary guide rails. The brake can also be provided for braking the counterweight.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1A:
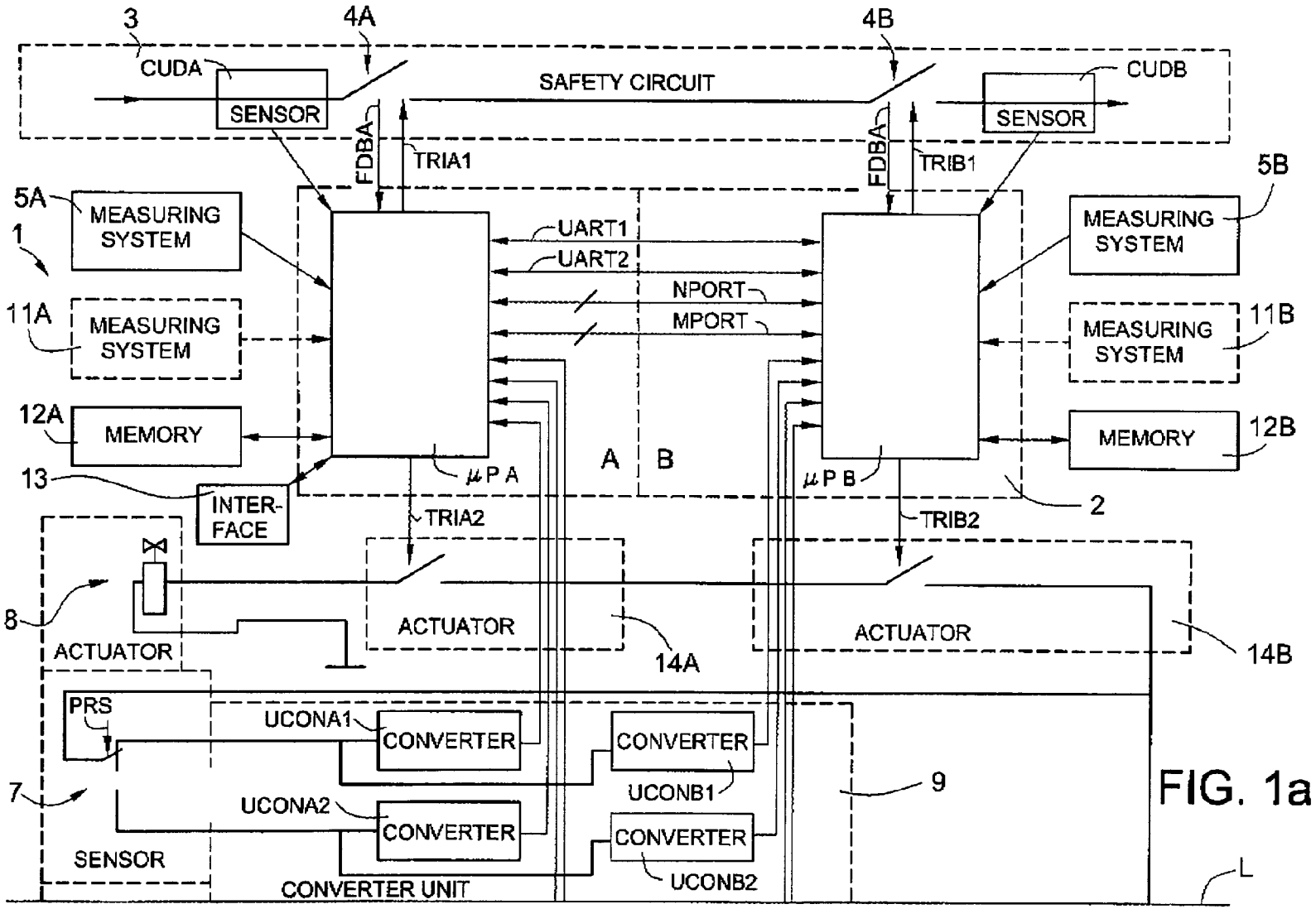
FIGS. 1*a* and 1*b* are a block circuit diagram of equipment for monitoring the speed of an elevator car according to the present invention.
Figure 1B:
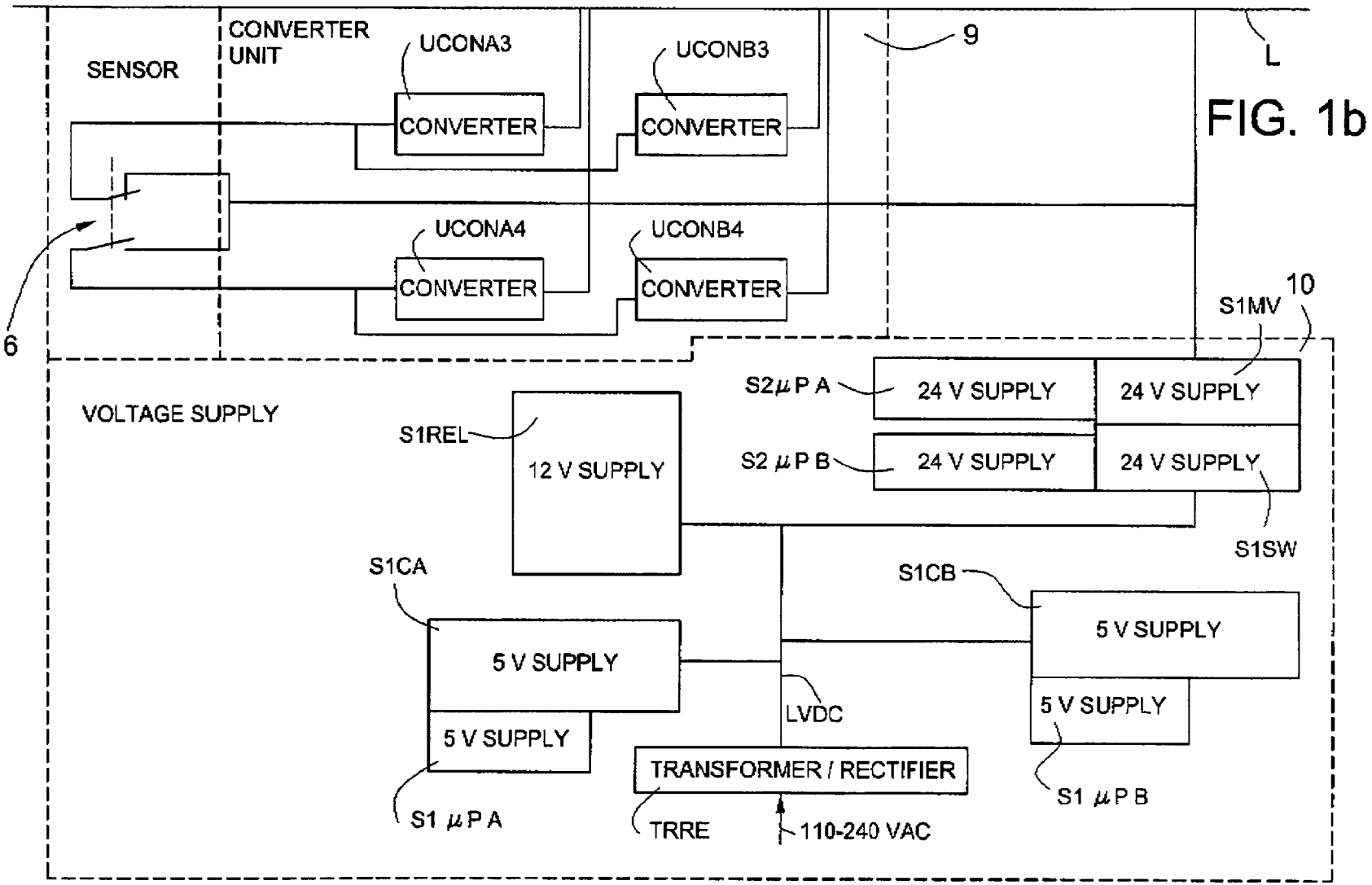

A block circuit diagram has, for illustrative reasons, been divided along a line L into FIG. 1*a* (upper) and FIG. 1*b* (lower), which together show equipment for monitoring the speed of an elevator car according to the present invention. The equipment, termed a detection system 1 in the following, substantially consists of a two-channel computer 2 with channel A and channel B, actuators 4A, 4B connected into a safety circuit 3 of the elevator control, a respective measuring system 5A, 5B per channel A, B for detection of the movement of the drive pulley driving the elevator car and the counterweight, a sensor 6 for monitoring a brake, a sensor 7 for monitoring the pressure medium (for example compressed air) of the brake, which acts in braking manner on the cable strand guided over the drive pulley, an actuator 8 for release of the brake against a spring force, a converter unit 9 for conversion in terms of voltage of sensor signals, and a voltage supply 10 for the computer 2, for the actuators and for the sensors. A respective measuring system 11A, 11B, which monitors the rotational movement of the drive motor, per channel can optionally also be connected with the computer 2. A memory 12A, 12B is provided for each channel. Maintenance personnel can communicate with the computer 2 by means of a man/machine interface 13.

The measuring system 5A, 5B can detect the movement of the drive pulley shaft or the movement of the drive pulley circumference, wherein, for example, scannable magnetic poles or optically scannable code discs are provided. The speed or the position of the elevator car, for example, can be determined by the measurement signals. The optional measuring system 11A, 11B monitoring the rotational movement of the drive motor is of comparable construction.

The man/machine interface 13 consists of, for example, a keyboard for input of data and parameters and a display for visualization of data and operational states.

The actuator 4A, 4B, for example a relay, is provided in the safety circuit 3 for each channel A, B. The relay is controlled in drive by means of lines TRIA1, TRIB1 from a dual microprocessor μPA, μPB, wherein the microprocessor μPA, μPB monitors the switching state of the relay by means of lines FDBA, FDBB. Moreover, the microprocessor μPA, μPB monitors the state of the safety circuit 3 by means of current sensors CUDA, CUDB.

A brake operated by compressed air is, for example, provided as the brake, wherein the compressed air is switchable by means of the actuator 8, for example a magnetic valve, and the pressure is measurable by means of the sensor 7, for example a pressure transducer, wherein a pressure PRS measured at the brake is converted into an electrical signal. An actuator 14A, 14B, for example a switch, is provided for each of the channels A, B. The switch is controlled in drive by means of lines TRIA2, TRIB2 from the microprocessor μPA, μPB. The brake is released if both of the actuators 14A, 14B are closed, wherein the compressed air overcomes the spring force of brake springs. It is established by the sensor 6 whether the brake is released or applied. Movement of the elevator car is freed only if the sensor 7 detects the corresponding pressure PRS in the pressure medium and the sensor 6 detects the brake as released.

The signals of the sensors 6, 7 are converted by means of the converter 9 into microprocessor-compatible signals. In the present example, twenty-four volt (24V) signals are converted into five volt (5V) signals by means of converters UCONA1, UCONA2, UCONA3, UCONA4, UCONB1, UCONB2, UCONB3, UCONB4 in the converter unit 9 and are fed, electrically separated, to the corresponding channel of the microprocessor μPA, μPB.

The voltage supply 10 produces the necessary supply voltages for operation of the detection system 1, wherein a mains voltage of 110-240 VAC is converted by means of transformer/rectifier TRRE into a low-voltage direct voltage LVDC. In the present example, five volts (5V) are produced by a supply S1μPA, S1μPB for the computer 2, five volts (5V) are produced by a supply S1CA, S1CB for the measuring systems 5A, 5B, 11A, 11B, twelve volts (12V) are produced by a supply S1REL for the actuators 4A, 4B, twenty-four volts (24V) are produced by a supply S2μPA, S2μPB for the computer 2, twenty-four volts (24V) are produced by a supply S1MV for the actuator 8 and twenty-four volts (24V) are produced by a supply S1SW for the sensors 6, 7.

The microprocessor channels μPA, μPB communicate with one another by means of data lines UART1, UART2, as well as NPORT and MPORT.

Figure 2:
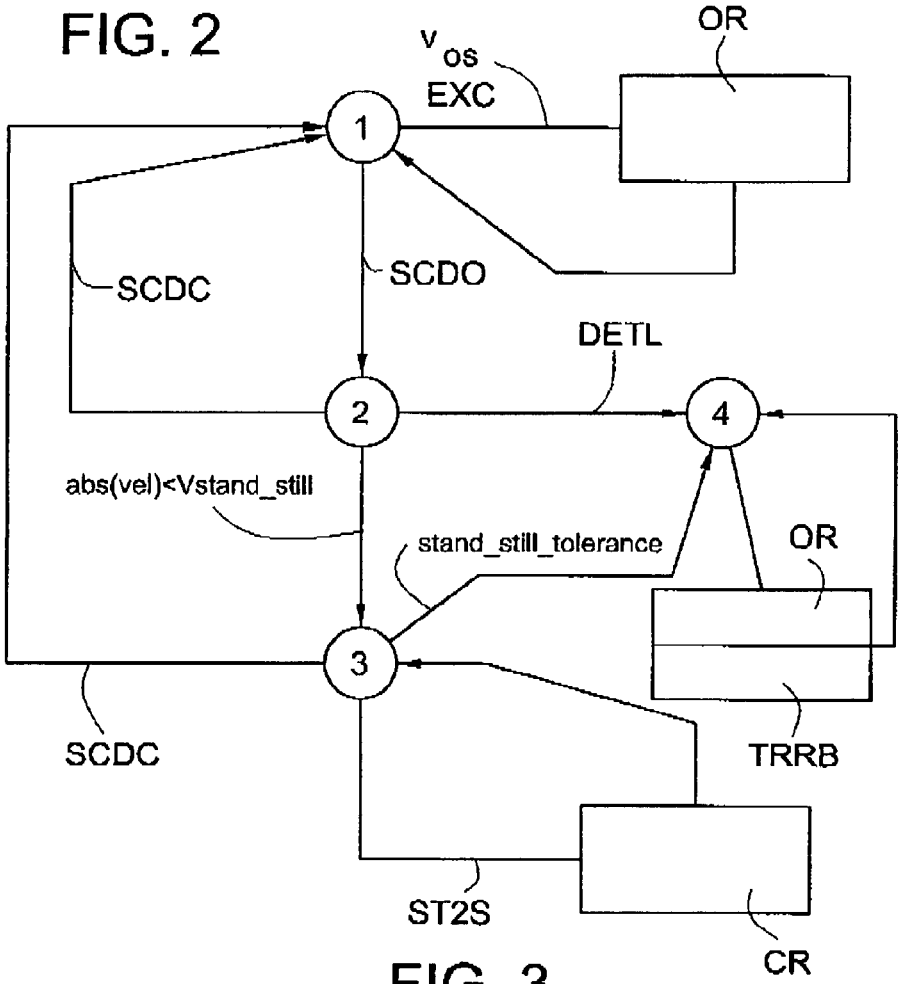
FIG. 2 is a flow diagram illustrating the operational states of the equipment for monitoring the speed of the elevator car shown in FIGS. 1*a* and 1*b*.
Figure 3:
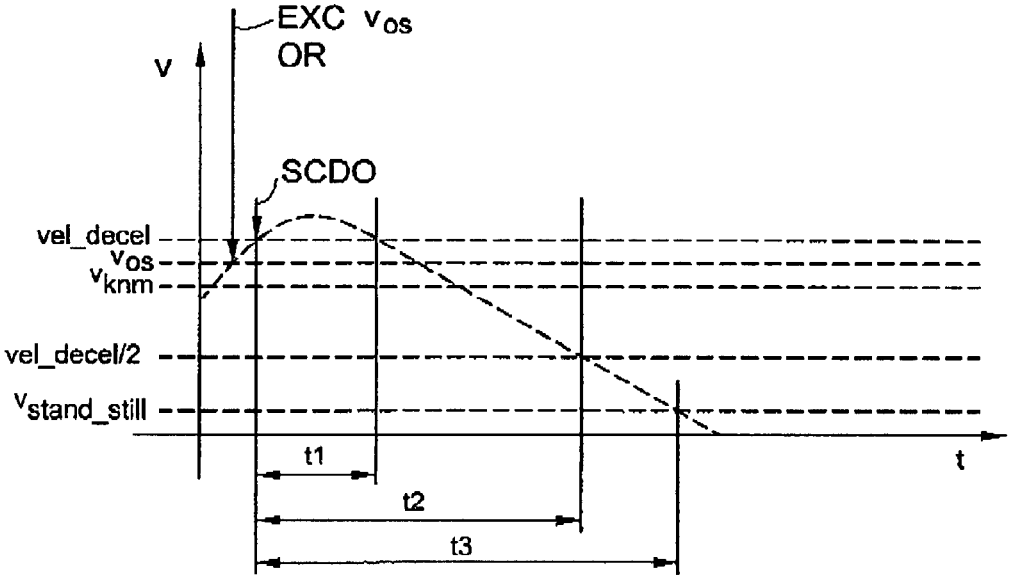
FIG. 3 is a plot of speed versus time for monitoring the speed of the elevator car.

FIG. 2 shows a flow diagram illustrating of the operating states of the detection system 1 and FIG. 3 is an associated speed diagram of the elevator car. The illustration shown in FIG. 2 is based on the state/event technique, in which the circles signify states of the system. Arrows with text or reference numerals symbolize events, which trigger a transition from one state to another state. Actions are symbolized by rectangles and text or reference numerals. For improved legibility, events or actions are represented in the description by bold type.

State 1 (circle 1) signifies a normal travel state. During travel of the elevator car, a speed limit designated as excess speed $v_{os}$ the elevator car is monitored. The safety circuit 3 is closed in the normal case. In the case of exceeding the excess speed limit $v_{os}$, detected as EXC, the safety circuit 3 is opened. The actuators or relays 4A, 4B are controlled in drive by means of the lines TRIA1, TRIB1 from the microprocessor EPA, μPB, wherein the microprocessor μPA, μPB monitors the switching state of the relays 4A, 4B by means of the lines FDBA, FDBB. In FIG. 2, the action of the safety circuit 3 being open with relay open is symbolized by a rectangle OR. The event safety circuit detected as open SCDO (detected by the microprocessor μPA, μPB) triggers a transition from the State 1 to a State 2 (circle 2).

State 2 signifies a retardation state. The drive unit (motor, brake) is switched over to braking, wherein the elevator car is retarded. A speed vel_decel of the elevator car has been stored at the time instant zero of detection of the safety circuit 3 as open. After a specific time t1, for example 500 ms, measured from the time instant zero the speed of the elevator car has to be less than vel_decel. The microprocessor μPA, μPB prepares the current data of the measuring system 5A, 5B and compares this data with vel_decel. If this condition (event too low retardation DETL) is not attained, a transition to a State 4 (circle 4, braking state by brake) is triggered (action relay open OR and brake triggered TRRB).

After a specific time t2, for example two seconds, measured from the time instant zero the speed of the elevator car has to be less than vel_decel/2. The microprocessor μPA, μPB prepares the current data of the measuring system 5A, 5B and compares this data with vel_decel/2. If this condition (event too low retardation DETL) is not attained, the transition to the State 4 (braking state with brake) is triggered. After a specific time t3, for example four seconds, measured from the time instant zero the speed of the elevator car has to be less than a standstill speed $v_{stand_still}$. The microprocessor μPA, μPB prepares the current data of the measuring system 5A, 5B and compares this with $v_{stand_still}$. If this condition (event too low retardation DETL) is not attained, the transition to the State 4 (braking state with brake) is triggered.

If the condition $v_{stand_still}$ is attained, a transition to a State 3 (circle 3 state of standstill monitoring) is triggered.

If an external device has opened the safety circuit 3, the transition to the State 1 (normal travel state) is triggered (event safety circuit detected as closed SCDC).

As soon as the State 3 with the event speed of the elevator car less than $v_{stand_still}$ ($abs(vel)<v_{stand_still}$) is attained, the instantaneous position of the elevator car is stored as a standstill position, wherein the microprocessor μPA, μPB prepares the current data of the measuring system 5A, 5B and determines the standstill position of the elevator car. If in the case of an opened safety circuit 3 the elevator car exceeds a specific deviation stand_still_tolerance (for example, 50 mm) from the standstill position, the transition to the State 4 (braking state with brake) is triggered.

After a specific time, for example two seconds, in the state of standstill monitoring, the actuators 4A, 4B are activated (event at least two seconds standstill ST2S). In FIG. 2 the action safety circuit 3 closed with relay closed CR is symbolized in a rectangle. The event safety circuit detected as closed SCDC (detected by the microprocessor μPA, μPB) triggers a transition from the State 3 to the State 1. The State 2 or the State 3 can trigger the transition to the braking state with brake (State 4). In the braking state the brake directly acting on the support cable of the elevator car is activated, wherein at least one of the actuators 14A, 14B is deactivated. In the activated state of the brake, compression springs produce the braking force at the support cables. For release of the brake, the actuators 14A, 14B are activated and the actuator 8 is supplied with current, wherein the compressed air acts against the spring force and releases the brake. As shown in FIG. 2, the State 4 cannot be left. Resetting of the State 4 can take place only by switching off or switching on the mains voltage.

The steps shown in FIGS. 2 and 3 are filed in coded form in the program memory 12A, 12B and are executed by the microprocessor μPA, μPB.

For determination of the speed limit denoted as excess speed $v_{os}$ of the elevator car a learning travel is performed, wherein the elevator car is moved, for example, in an upward direction at nominal speed and in that case the speed measured by the measuring system 5A, 5B is stored as $v_{knm}$. The travel direction of the elevator car is also detected, which is of significance for the counting direction of the measuring system 5A, 5B. The excess speed $v_{os}$ is referred to the nominal speed $v_{knm}$ and lies, for example, 10% above the nominal speed $v_{knm}$. The standstill speed $v_{stand_still}$ is referred to the nominal speed $v_{knm}$ and is detected, for example, as follows:

$v_{stand_still}=v_{knm}/32$ for elevators with $v_{knm}$ of 1 m/s to 1.75 m/s $v_{stand_still}=v_{knm}/16$ for elevators with $v_{knm}$ of 0.5 m/s to 0.99 m/s $v_{stand_still}=v_{knm}/8$ for elevators with $v_{knm}$ of 0.25 m/s to 0.49 m/s.

The monitoring of the standstill position of the elevator car is of significance particularly in the case of boarding and disembarking or when car door and shaft door are open. Normally in the case of a stop at a floor the threshold of the car door is, in height, approximately flush with the threshold of the shaft door. If the elevator car leaves its standstill position, then a height difference arises between the thresholds, which can lead to accidents during boarding and disembarking. In the extreme case a gap and thus an open elevator shaft can arise between the elevator car and the floor.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of monitoring a speed of an elevator car, wherein movement of a drive pulley driving the elevator car and a counterweight is detected and evaluated and retardation of the elevator car is initiated in the case of an impermissible deviation of the speed of the elevator car from a speed preset, comprising the steps of:

a. performing a learning travel by moving and measuring a speed of the elevator car, wherein the speed of the elevator car measured during the learning travel is stored as a nominal speed of the elevator car;

b. providing the elevator car at a stop at a floor;

c. monitoring the drive pulley directly for movement of the elevator car and comparing the speed of the elevator car with a standstill speed to detect whether the elevator car leaves a standstill position, wherein the standstill speed is a fraction of the nominal speed of the elevator car, and the standstill position is an instantaneous position of the elevator car when the speed of the elevator car is less than the standstill speed; and d. in response to detecting that the elevator car has left the stop by determining that the elevator car has exceeded a specific deviation from the standstill position, activating a brake to stop the elevator car.

2. The method according to claim 1 including closing a safety circuit of the elevator car after a specific time of the monitoring when the speed of the elevator car has remained lower than the standstill speed.

3. The method according to claim 1 including setting the standstill speed at the nominal speed divided by 32 when the nominal speed is in a range of 1 m/s to 1.75 m/s, at the nominal speed divided by 16 when the nominal speed is in a range of 0.5 m/s to 0.99 m/s, and at the nominal speed divided by 8 when the nominal speed is in a range of 0.25 m/s to 0.49 m/s.

4. The method according to claim 1 wherein the brake to stop the elevator car acts in braking manner on a cable strand guided over the drive pulley.

5. A detection system for monitoring a speed of an elevator car comprising:

a measuring system for directly detecting and generating an output signal representative of a movement of a drive pulley driving the elevator car and a counterweight; and a computer for evaluating said output signal from said measuring system, wherein when the elevator car is provided at a stop at a floor, the computer monitors the output signal for movement of the elevator car and compares a speed of the elevator car with a standstill speed to detect whether the elevator car leaves a standstill position, wherein the standstill speed is a fraction of a nominal speed of the elevator car, wherein the nominal speed is determined by performing a learning travel by moving and measuring a speed of the elevator car, wherein the speed of the elevator car measured during the learning travel is stored as the nominal speed of the elevator car, and the standstill position is an instantaneous position of the elevator car when the speed of the elevator car is less than the standstill speed, and in response to detecting that the elevator car has left the stop by determining that the elevator car has exceeded a specific deviation from the standstill position, the computer activates a brake to stop the elevator car.

6. The detection system according to claim 5 wherein said computer closes a safety circuit of the elevator car after a specific time of the monitoring when the speed of the elevator car has remained lower than the standstill speed.

7. The detection system according to claim 5 wherein said computer and said measuring system have two signal processing channels, and wherein said computer switches on and off by way of said two channels a safety circuit of the elevator or actuators of a brake, and detects signals of sensors of the brake.

8. The detection system according to claim 5 further comprising:

said computer being a two-channel computer;

a pair of actuators connected into a safety circuit of an elevator control;

said measuring system being a pair of measuring systems each connected to an associated one of the channels for detection of the movement of a drive pulley driving the elevator car and a counterweight through a cable strand;

a first sensor connected to said computer for monitoring a brake;

a second sensor connected to said computer for monitoring a pressure medium supplied to the brake, which brake acts in braking manner on the cable strand guided over the drive pulley;

a brake actuator for releasing the brake against a spring force;

a converter unit connected to said computer and to said second sensor for conversion of sensor signals to voltage signals; and a voltage supply connected to said computer, said pair of actuators, said brake actuator, said first sensor and said second sensor.

9. The detection system according to claim 8 including another pair of measuring systems each connected to an associated one of the channels for detection of the movement of the drive pulley driving the elevator car and the counterweight through the cable strand.

10. The detection system according to claim 8 including a separate memory connected to each channel.

11. The detection system according to claim 8 including a man/machine interface connected to said computer whereby a person can communicate with said computer through said man/machine interface.

* * * * *